US005690227A

United States Patent [19]

Lutz

[11] Patent Number: 5,690,227

[45] Date of Patent: Nov. 25, 1997

[54] SYSTEM FOR USE IN RECYCLING OF WASTE MATERIAL

[76] Inventor: Theodore A. Lutz, 2398 Rochester Rd., Sewickley, Pa. 15143

[21] Appl. No.: 645,278

[22] Filed: May 13, 1996

Related U.S. Application Data

[60] Division of Ser. No. 847,631, Mar. 9, 1992, Pat. No. 5,542,538, which is a continuation-in-part of Ser. No. 486, 501, Feb. 28, 1990, abandoned.

[51] Int. Cl.[6] ..... B65D 33/12

[52] U.S. Cl. ..... 206/442; 206/83.5

[58] Field of Search ..... 8/115.7, 116.1; 428/2, 34.2, 34.3; 206/442, 554, 83.5, 215, 527

[56] References Cited

U.S. PATENT DOCUMENTS 3,780,854 12/1973 Ruppenthal ..... 206/83.5 X 4,059,222 11/1977 Gamble ..... 383/95 X 5,542,538 8/1996 Lutz ..... 206/442

*Primary Examiner*—Jacob K. Ackun

*Attorney, Agent, or Firm*—Clifford A. Poff

[57] ABSTRACT

A system of waste material recycling involving the formation of bales of recyclable waste, the bales consisting essentially of recyclable waste material and waste storage containers therefor, wherein the waste storage containers are filled by the individual consumer with the recyclable waste material prior to the formation of the bales and are formed of material that is compatible for recycling with the waste material. The waste storage containers are preferably obtained simultaneously with, and as a component of, the goods which ultimately become the recyclable waste material stored in the containers. In the preferred embodiment, the waste storage container comprises a compactly packaged storage container which is compatible for recycling with newsprint and obtained simultaneously with, and as a component of, a single edition of a newspaper, or the like.

2 Claims, 3 Drawing Sheets

SYSTEM FOR USE IN RECYCLING OF WASTE MATERIAL

CROSS REFERENCE TO RELATED PATENT APPLICATION

This application is a division of application Ser. No. 07,847,631, filed Mar. 9, 1992 now U.S. Pat. No. 5,542,538, which is a continuation-in-part of United States Patent Application Ser. No. 07/486,501, Filed Feb. 28, 1990 now abandoned.

BACKGROUND OF THE INVENTION

1. Field of the Invention

The present invention relates generally to an article of manufacture for use in recycling of waste materials, and, more particularly, to a recyclable article in the form of a newsprint in a storage container suitable for baling and a method for recycling such bales, the bales consisting essentially of newsprint and storage containers therefor, wherein the storage containers are formed of material compatible for recycling with the newsprint.

2. Description of the Prior Art

One example of a recycling program provides that waste products at the level of an individual household or small commercial establishment are collected in diverse containers according to categories of the products, e.g., glass, plastic, metal and paper. The recyclables in the individual containers are delivered to appropriate ones of diverse waste recycling facilities for processing. Some recycling programs provide that the waste products at the source of origin are collected as a recycling unit and later separated to form individual classes of recycling materials. Metals, plastics and glass can be successfully handled in this manner but waste newsprint becomes highly contaminated by broken glass and liquids. When so contaminated, the newsprint is a waste not a recyclable product.

Such methods have either required the individual to personally transport the packaged waste products to designated collection center(s) or the waste products were left "curb-side" where they were collected by a collection authority. Examples of containers for newsprint are found in U.S. Pat. Nos. 1,557,881, issued Oct. 20, 1925; 2,971,643, issued Feb. 14, 1961; 3,780,854, issued Dec. 25, 1973; and 4,229,493, issued Oct. 21, 1980. It is also known in the art to form baled products primarily comprised of waste newsprint as disclosed, for example, in U.S. Pat. Nos. 1,846,585, issued Feb. 23, 1932; 3,762,454, issued Oct. 2, 1973; and 4,059,222, issued Nov. 22, 1977.

Aside from the obvious inconveniences and disadvantages of spent transportation time and expense, major disadvantages arise when the individual is required to personally transport the waste products to the designated collection centers. First, if the waste storage containers are not supplied in some routine manner, e.g., by a recycling authority, to the individual at little or no cost, then obtaining and maintaining a supply of appropriate waste storage containers, whether they be reusable or not, requires a cost outlay by the individual participation by individuals is likely to be reduced. And, if the storage containers are reusable, whether purchased or not by the individual, they require an inventory and thereby occupy valuable storage space in the individual's household or place of business.

Another serious concern, regardless of whether the waste is transported to the waste recycling center by individuals or a collection authority, is the disposal of the waste storage containers at the waste recycling center. That is to say, if the container and waste are incompatible for recycling together, e.g., waste paper packaged in plastic bags, then the waste paper must be removed from the multitude of plastic bags prior to recycling at a paper mill. The dissimilar material comprised of the plastic bags is an unacceptable foreign contaminant detrimentally affecting the compositional integrity of the final recycled waste product. Consequently, the accumulation of discarded waste storage containers generates a secondary waste disposal problem requiring additional expenditures of resources in order to separately dispose of the waste storage containers.

To fully understand the newsprint recycling process of the present invention the paper making process and materials by which the newsprint was obtained will give information about the waste newsprint. Wood fibers used in papermaking are derived from hardwoods and softwoods. Softwoods have longer fibers contributing strength in the paper but the fibers can make the paper rough or coarse and, therefore, hardwood fibers are used as a filler to make the paper smoother and suitable for printing. Most newsprint is made from a blend of both types of wood fibers to achieve the desired final properties. In the papermaking process, the wood fibers are joined together by hydrogen bonds. The bonding process is achieved by the polarity of water and pressure of hydroxyl groups on the wood fibers. To recycle the newsprint, a repulping process similar to the origin pulping process is undertaken. The repulping process includes separating the newsprint into individual fibers. Complicating factors to the repulping process include coatings on the newspaper; chemical treatments to the paper; and presence of penetrating ink. The fibers must be separated before deinking. Deinking is accomplished by using well known procedures as disclosed, for example, in U.S. Pat. No. 2,916,412, issued Dec. 8, 1959 and U.S. Pat. No. 3,932,206, issued Jan. 13, 1976. Because the act of papermaking caused the fibers to bond together, in order to reuse the fibers from wastepaper, these bonds must be broken to separate the fibers once again. It is practically impossible to break the fibers apart without damaging them somewhat. All of these factors conspire to make paper produced from recycled fiber different from paper made from virgin fiber. The difference is importantly a much lower potential for strength.

Recycled fibers can be used with virgin fiber in quantities based on the required strength and purity. However, recycled wood fibers are lower in strength than if the same blend of fibers was obtained as unused pulp. While it is possible to clean and bleach recycled fibers to produce high-quality paper, the cost for the cleaning and bleaching offsets the savings from the use of lower cost wastepaper as a raw material. The recycled fiber is obtained primarily from newspapers and corrugated containers and used for combination boxboard and other products where cleaning is not needed. Combination boxboard is used for cereal cartons or other boxes made from board that has a gray layer in the center and sometimes sandwiched between layers of white pulp.

The present invention seeks to produce recycled newsprint using waste newsprint as a major source of useful wood fibers without degrading as to color quality and strength. Virgin wood fiber for newsprint is commonly obtained by mechanical methods particularly ground wood pulp process for liberating wood fibers. As a result, the newsprint has a slightly yellow appearance of fair to low strength. These processes are used primarily on softwoods to maximize the strength of the pulp because of a long wood fiber.

Ground wood is used for newsprint without bleaching. Bleaching is associated with pulping but reduces the yield of the pulping operations. Bleaching can also be a purification operation since the chemicals react to remove colored materials, e.g., natural glues in the wood and from the fibers. Bleaching has little effect on the strength of the resultant paper unless the pulp is bleached extensively or to very high brightness. The major reason for bleaching is its effect on the whiteness or brightness of the paper.

Due to the immense quantity of newsprint which is generated, consumed and discarded on a daily basis, the ever increasing cost of landfill disposal and the severe depleting effect such activity has on commercial forest resources and waste landfill sites, an urgent need has arisen for ways and means for efficient recycling of newsprint involving the cooperative efforts of the individual and the recycling industry.

During the rigors of recycling a quantity of newsprint at a paper mill, because of the very nature of the material, a portion of sub-standard paper fibers is normally generated which must be extracted after repulping. As a result, replenishment of a generally equal portion of compatible higher quality paper fibers is required in order to maintain the recycled newsprint within predetermined commercially acceptable quality or tolerance standards. At present, assurance of the replenishment of the appropriate portion of compatible higher quality paper fibers entails essentially continuous performance of labor intensive testing and quality control measures at the paper mill. The chemistry of the waste newsprint varying with origin of the newsprint. Hence, a need exists for a "self-regulating" newsprint recycling process which greatly reduces or, preferably, eliminates labor intensive testing and quality control measures in order to identify corrective measures including replenishment of an appropriate quantity of higher quality paper fibers into the recycling process. Widely varying differences to the chemical and fiber composition need to be reduced which is possible by integrating in the waste newsprint a normalizing factor so that a consistent chemical and source of strength enhancing wood fibers exists to replenish sub-standard wood fiber that must be discarded during the recycling.

A general advantage exists, therefore, for a system of waste material recycling involving the formation of bales of recyclable waste consisting essentially of recyclable waste material and waste storage containers therefor, wherein the waste storage containers are filled by the individual consumer with the recyclable waste material prior to the formation of the bales and are formed of material that is compatible for recycling with the waste material, such that the containers and their contents form unitary disposable packages of recyclable waste.

A more particular advantage exists for an efficiently recyclable baled article consisting essentially of waste newsprint and containers therefor, the containers being formed of a material which is compatible for recycling with newsprint.

A further advantage exists for waste storage containers which are preferably obtained conveniently obtained simultaneously with, and as part of, the goods which ultimately become the recyclable waste material stored in the containers.

A more particular advantage exists for a waste storage container which is formed of material compatible for recycling with newsprint and conveniently included as a component of a newspaper.

A still further advantage exists for a "self-regulating" newsprint recycling process which assures replenishment of a quantity of sub-standard paper fibers extracted during recycling with an appropriate quantity of compatible higher quality paper fibers.

It is therefore an object of the present invention to provide a system for waste material recycling involving the formation of bales of recyclable waste consisting essentially of recyclable waste material and waste storage containers therefor, wherein the waste storage containers are filled by the individual consumer with the recyclable waste material prior to the formation of the bales and are formed of materials that are compatible for recycling with the waste material.

It is a more particular object of the present invention to provide an efficiently recyclable baled article consisting essentially of waste newsprint and containers therefor, the containers being formed of material which is compatible for recycling with newsprint.

It is a further object of the present invention to provide articles or containers which are conveniently obtained simultaneously with, and as part of, the goods which ultimately become the recyclable waste material stored in the containers.

It is a more particular object of the present invention to provide a waste storage container which is formed of material compatible for recycling with newsprint and conveniently included as a component of a newspaper.

It is a still further object of the present invention to provide a "self-regulating" recycling process for newsprint which assures replenishment of a quantity of sub-standard paper fibers extracted during recycling with an appropriate quantity of compatible higher quality paper fibers.

Still other objects and advantages of the present invention will become obvious in light of the attached drawings and written description of the invention presented herebelow.

SUMMARY OF THE INVENTION

The present invention provides a system of waste material recycling involving the formation of bales of recyclable waste, the bales consisting essentially of recyclable waste material and waste storage containers therefor, wherein the waste storage containers are filled by the individual consumer with the recyclable waste material prior to the formation of the bales and wherein the container is comprised of a material that is compatible for recycling with the waste material bleached paper primarily long grain soft wood fibers in quantities such that during recycling with the waste newsprint, the fibers replenish sub-standard paper fibers extracted and lost during recycling of waste newsprint. The waste storage containers are preferably obtained simultaneously with, and as a component of, the goods which ultimately become the recyclable waste material stored in the container. In the preferred embodiment, the waste storage container comprises a compactly packaged storage container which is compatible for recycling with newsprint and obtained simultaneously with, and as part of, a single edition of a newspaper, or the like.

DESCRIPTION OF THE PREFERRED EMBODIMENTS

Figure 1:
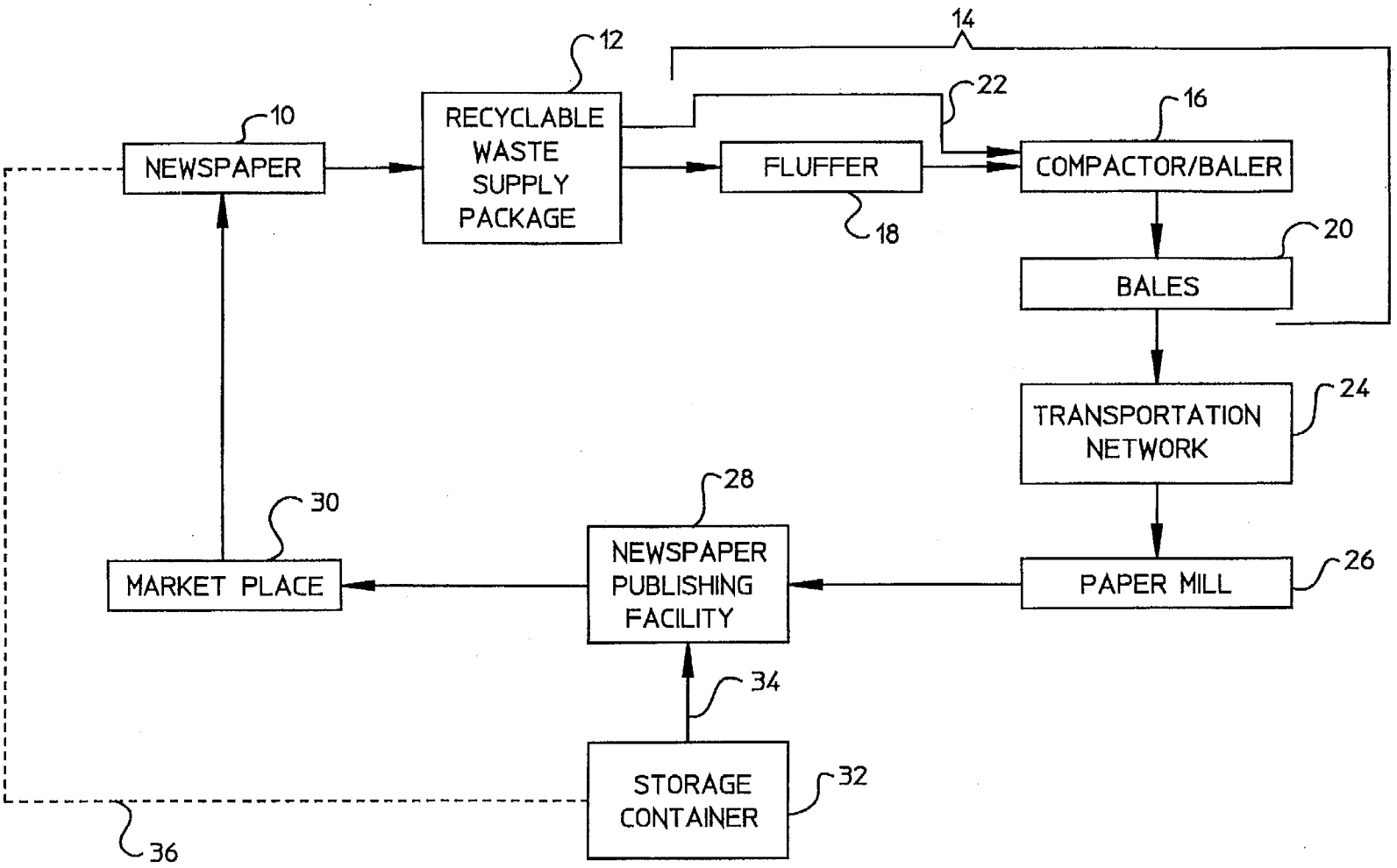
FIG. 1 is a schematic representation of a waste material recycling system arranged in accordance with the preferred embodiment of the present invention.

Turning to FIG. 1, in which there is depicted a schematic representation of a waste material recycling system arranged in accordance with the preferred embodiment of the present invention, it is seen that the system essentially begins and ends with discrete quantities of recyclable consumer goods, preferably in the form of individual newspapers, herein designated by the numeral 10. In this and the remaining figures to be described hereinbelow, the consumer goods 10 are disclosed as taking the form of newsprint since conventional and relatively low quality newsprint paper finds particularly beneficial and practical application to the recycling system of the present invention. That is to say, the unique difficulties and peculiarities encountered in the recycling of newsprint are well tended by the integrated recycling system described herein.

The initiation of the recycling system begins with the purchase of a newspaper 10 by a consumer. Preferably, as a convenience to the consumer, the newspaper 10 includes as a component thereof a recyclable storage container, a specific example of which is described hereinbelow, formed of material which is compatible for recycling with the newspaper 10. As an alternative arrangement, however, it is also contemplated that the storage container may be purchased or otherwise obtained, as by free public delivery, for example, as a component which is separate from the newspaper. Once read or otherwise used, the newspaper 10 then becomes waste material which is placed in the waste storage container in order to create a unitary waste package 12 formed essentially entirely of materials which are compatible for recycling with one another. As is customary, the waste package 12 is either left curb-side for collection by an appropriate collection authority or is delivered directly by the consumer to a designated collection center. If the collection center is not also a recycling facility, then the collected packages of waste material are delivered by suitable means, i.e., truck, train, barge, or the like, to the appropriate recycling facility 14 which typically includes at least one compactor/baler 16 and may further include at least one waste conditioner 18.

The bales 20 formed by the compaction and baling of many individual ones of the waste packages 12 such that a given bale generally weighs on the order of 1300 to 1500 lbs. (minimum weight approximately 1000 lbs.) and typically have dimensions on the order of 29"×40"×60" when compressed in the compactor/baler 16 compression chamber and roughly 30"×46"×48"×60" when removed therefrom. It will be understood, however, that the sizes and weights of the bales 20 will vary according to the capacities of differing compactor/balers and the specifications dictated by the means of transportation selected to transport the bales 20 to a suitable processing facility to be described hereinbelow.

Within the preferred embodiment of the present invention, that is, the recycling of newsprint, the waste conditioner may take the form of fluffier device 18 if the waste newsprint units or packages 12 are of such density that they preclude efficient compacting or baling with one another by the compactor/baler 16 and/or they overload the compaction or waste shearing systems of the compactor/baler. A typical configuration for the fluffier device 18 is a rotatable arbor having a plurality of radially projecting beater-like members sometimes lengths of chains attached to its periphery. Upon passage of the waste packages through fluffier device 18, they become thrashed by the beater members so as to be increased in volume and decreased in density. Hence, the reduced density packages pose less resistance to the compaction and/or shearing mechanisms of the compactor/baler 16.

A suitable fluffier device of the aforementioned type is manufactured by the Harris Press and Shear, Inc. of Cordele, Ga. and may comprise an attachment to the compactor/baler 16. A suitable compactor/baler for the present invention is also manufactured by Harris Press and Shear, Inc. Thus the essential component of the recycling facility 14 is the compactor/baler 16 with the waste conditioner(s), e.g., fluffier device 18, being optional. Aside from taking the form of a single fluffier device 18, the waste conditioner(s) may comprise an assortment of devices including chemical treaters, heat treaters, cleaners, decontaminators, etc., operable to function either individually with compactor/baler 18 or in various combinations therewith.

The situation in which the waste packages 12 do not require fluffing or other preliminary conditioning and hence pass directly from a delivery truck, for example, to compactor/baler 16 is indicated by the arrow 22 depicted in FIG. 1.

From the recycling facility 14, the bales of recyclable material 20 are then transported through a suitable transportation network 24 to a processing facility in the form of a paper mill, herein designated by the numeral 26, whereat the bales 20 are processed into rolls of newsprint. Due to economic factors influenced by the great bulk and weight considerations attendant to the transport of large numbers of bales 20 to the paper mill 26 at a steady rate, the transportation network 24 most preferably used in accordance with the present invention comprises sea and/or rail shipping. However, although not preferred for reasons of cost inefficiency, the bales 20 could be shipped to the paper mill 26 by truck if desired or if it is the only means of high-volume transportation available between the recycling facility 14 and paper mill 26.

A typical grade or material composition of paper which may be supplied by the recycling facility 14 to the paper mill may be defined as follows:

A fiber supply containing 65% to 75% #6 *News* (PS-86), which shall be baled newspapers containing less than 5% of other papers; the prohibitive materials in the supply may not exceed ½ of 1%, and total out-throws may not exceed 2%; the remaining 25% to 35% of the supply in each load will be magazine stock containing less than 5% of other papers, less than ½ of 1% of prohibitive materials and less than 2% of total out-throws; the #6 *News* and magazine stock portions may be inter-mixed within each bale 20 or within each load; the breakdown of percentages, i.e., 65% to 75% #6 *News* and 25% to 35% magazine stock, must be maintained within each separate shipment to ensure that the proper mix of fibers can be processed at the mill 26 on a consistent, daily basis (all percentages expressed representing weight percentages).

One skilled in the art will readily appreciate that the aforementioned composition definition will vary somewhat according to the requirements of the individual paper mill; however, the essential point to be emphasized is that the bales 20 in all cases consist essentially of a majority portion of newsprint and a balance portion of paper material readily compatible with newsprint, in this case storage containers preferably formed at least in part of bleached white soft wood fiber paper stack and can take the form of bleach draft clay coated for presenting a high quality surface suitable for quality printing of advertisement to affect the bag and recycling costs as well as instruction information inductive of obtaining consumer precipitation in a recycling program at hand. Bleached white clay coated kraft has fiber content compatible with newsprint paper and is easily, efficiently and readily compatible for recycling therewith and useful to supply long soft wood fiber to replenish the quantity of sub-standard paper fibers which are extracted from the newsprint pulp during processing at the paper mill 26. The storage containers will form a quantity of higher quality paper fibers in order to materially contribute to the maintenance of the recycled newsprint within predetermined quality or tolerance standards. As will be discussed hereinbelow, the material composition of the storage containers serves to impart a "self-regulating" effect on the quantity of higher quality long fibers which are replenished during processing of the paper at the paper mill 26.

After transportation from the paper mill 26 by suitable means, the recycled newsprint arrives at a newspaper publishing facility 28 whereat the newsprint is printed into newspapers which are delivered into the marketplace 30, e.g., individual homes, businesses, newspaper dispensing machines, newsstands, and the like. In accordance with the preferred embodiment of the present invention, for the purpose convenience to the consumer and assurance of distribution, the individual newspapers 10, prior to reaching the marketplace 30, possess as a component thereof a waste storage container 32 formed of material which is compatible for recycling with the remainder of the newsprint forming the newspaper 10. The storage container is thus most preferably added to the contents of the newspaper at the publishing facility 28, as indicated by arrow 34 in FIG. 1. However, although preferred, it is not a requirement that the storage container 32 be a component the individual newspaper 10. For example, storage container 32 may be purchased or otherwise obtained, perhaps by free delivery from a designated recycling authority, at a time and/or location separate from the moment of obtaining the newspaper 10, as is indicated by dashed-line arrow 36 depicted in FIG. 1.

Figure 2:
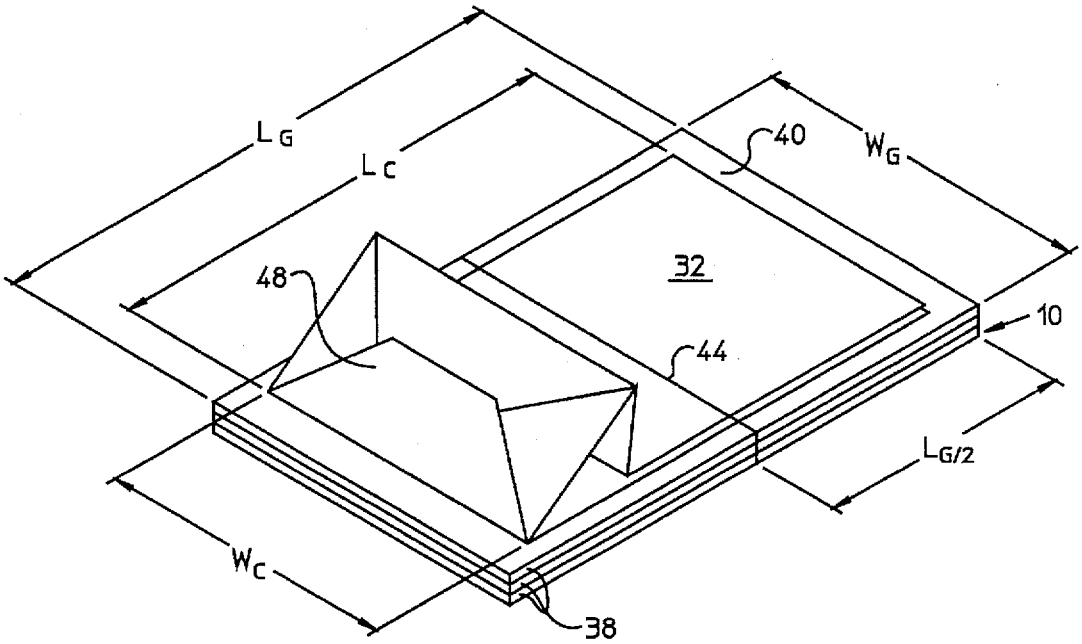
FIG. 2 is a perspective view of a preferred form of recyclable consumer goods which find particularly beneficial application to the recycling system of the present invention, the consumer goods including as a part thereof a recyclable waste storage container for the consumer goods formed of a material compatible for recycling with the consumer goods.

An example of a preferred form of consumer goods package which is particularly well-suited for the recycling system according to the present invention is depicted in FIGS. 2–5. With particular reference to FIG. 2, there is clearly seen the consumer goods package initially obtained by the consumer. The consumer goods package most fundamentally includes a quantity of newsprint in the form of the aforementioned newspaper 10 which is typically comprised of one or more individual sections 38. The newspaper 10 in FIG. 2, for purposes of clarity in description, is shown unfolded and face down, i.e., with its front page at the bottom, not shown, and with its back page 40 on top.

Positioned on the top of the back page 40 of newspaper 10 is a waste storage container 32 formed either of newsprint paper or other material composition compatible with newsprint paper for efficient recycling/processing therewith.

Formed as such, the waste storage container 32, depicted herein as a bag-like container, may be laid flat on top of the back page 40 and folded along the newspaper fold line 44 so as to be included as an enclosure of the newspaper 10, hence forming a component of the consumer goods package. As should be appreciated, container 32 may also be folded to a much more compact configuration than that illustrated, if desired. Furthermore, although illustrated as a bag-like container, it is contemplated that waste storage container 32 may assume other suitable configurations such as, for example, a sheet of wrapping material having mating tabs and slots for maintaining the structural integrity of the container 32 when wrapped about a quantity of waste material, thereby positively retaining the waste material therewithin.

In accordance with the preferred embodiment of the present invention, i.e., the article of manufacture for use in recycling of newsprint, aside from the criticality of the composition of the material which is employed as the waste storage container 32, for purposes of practicality, the dimensions of the container 32 also assume particular significance. That is to say, although container 32 may be of a size which, when opened, can essentially receive and contain only the newspaper 10 with which it initially formed a package of consumer goods, it is preferred that container 32 be of a capacity suitable to accommodate a plurality or several editions of newspapers and, most preferably, at least a complete one-week supply of newspapers 10.

With reference to FIG. 2, it will be seen that the length Lg and width Wg of the goods (unfolded newspaper 10) are preferably greater than the length Lc and width Wc, respectively, of the waste storage container or bag 32 in order that newspaper 10 and bag 32, when folded, present an aesthetically pleasing package of consumer goods. Bag 32 most preferably has an open top 46 and a closed bottom 48, with the bottom 48 being closed by an adhesive or preferably mechanical fastening members, which, if not wholly compatible for recycling with newspaper 10 and bag 32, is of a material or composition which represents either an insignificant and acceptable quantity of contaminant or an easily removable constituent of the newsprint recycling process.

Figure 3:
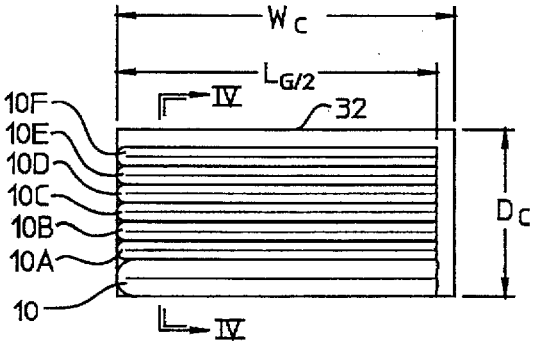
FIG. 3 is a plan view of the recyclable waste storage container of FIG. 2 in fully opened condition and containing therein a quality of waste material in the form of a predetermined supply of the used recyclable consumer goods of FIG. 2.

FIG. 3 clearly illustrates that Lg/2, or the length of the newspaper 10 and/or other newspapers 10A through 10F in normally folded condition, is determinant of the preferred minimum acceptable width Wc of the storage container or bag 32. That is to say, Wc should generally be slightly greater than Lg/2 in order to most compactly store the folded used newspaper 10 and, if necessary, other folded editions of newspaper 10A–10F. With particular attention being paid to FIG. 3, that newspaper 10 in folded condition is significantly thicker than each of newspapers 10A through 10F in similar folded condition. This particular detail is provided to indicate that newspaper 10 most preferably represents the most voluminous edition of a daily newspaper, which, in most areas, is the Sunday edition. Numerals 10A through 10F, therefore, as should now be apparent, represent the Monday through Saturday editions. It should also be appreciated that the waste storage container 32 is not limited to being a component of a single and specific edition of a daily newspaper, but may be a component of one or more of any editions thereof.

Figure 4:
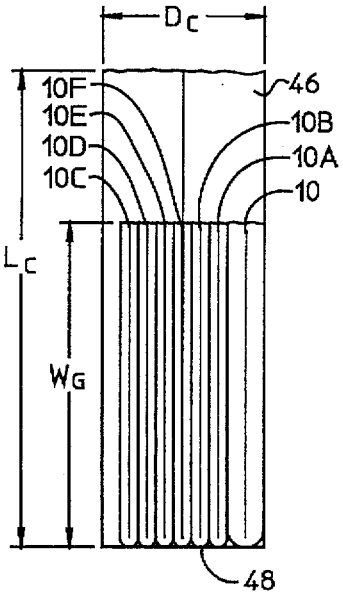
FIG. 4 is a sectional view of the filled recyclable waste storage container according to the present invention as taken in the direction of arrows IV—IV of FIG. 3.
Figure 5:
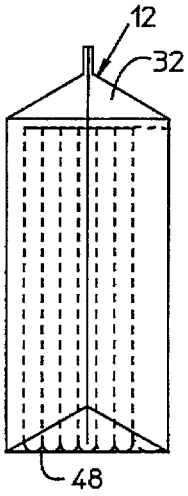
FIG. 5 is a side elevational view of the filled recyclable waste storage container of FIG. 3 in a closed condition.

According to the preferred embodiment of the present invention, FIGS. 3 and 4 illustrate the maximum depth Dc of container or bag 32 in a fully opened condition suitable for accommodating the aforementioned one-week supply of folded newspapers 10 and 10A–10F. The preferred dimension for Dc is ideally only slightly greater than the maximum "worst case" thickness of a one-week supply, i.e., Sunday through Saturday inclusive, of folded editions of a daily newspaper. The "worst case" thickness is preferably initially determined through historical analysis of the thickness of a plurality of previously published one-week packets of editions of the newspaper and, if necessary, periodically adjusted responsive to ongoing analysis of the thicknesses of subsequently published one-week packets of the newspaper. As noted hereinabove, however, Dc maybe of a dimension sufficient to accommodate as little as a single daily edition or even more than a one-week supply of editions, although capacity for a one-week supply is preferred.

Turning to FIG. 5, again in accordance with the preferred embodiment of the present invention, upon filling of the bag 32 with the one-week supply of newsprint, the top of the bag is folded in such manner as to envelop the supply of newsprint therewithin in order to create a unitary waste package 12 formed essentially entirely of materials compatible for recycling with one another.

Furthermore, during compaction at a recycling facility 14 having high-powered baling and shearing mechanisms, i.e., one requiring no fluffier device 18, the containers 32 restrain their contents in an organized fashion whereby the waste packages 12 act as unitary components in a mass which permits compaction to greater density than can be achieved by baling unrestrained and randomly oriented waste materials.

Figure 6:
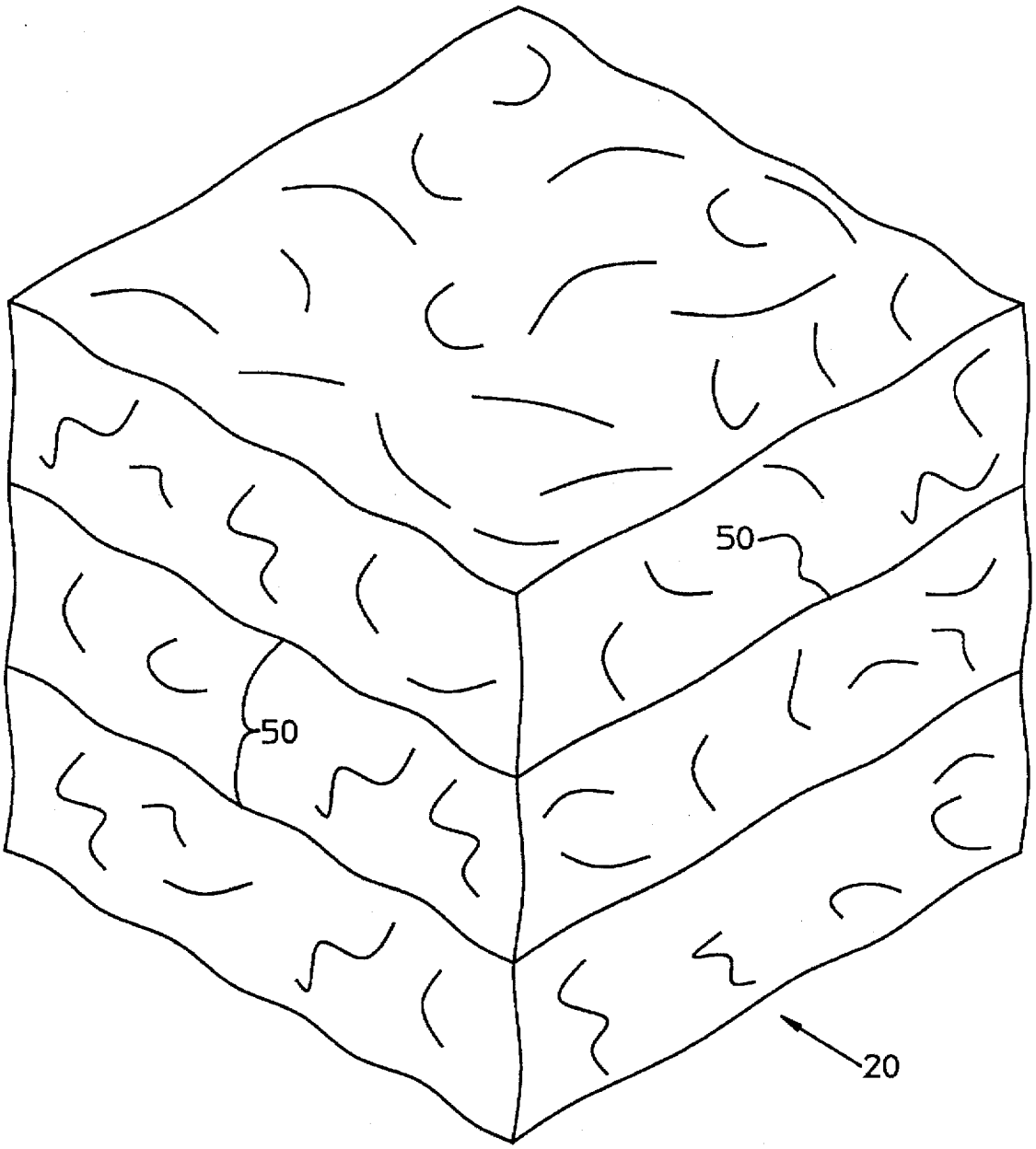
FIG. 6 is a baled article of recyclable material formed in accordance with the present invention.

Turning to FIG. 6, there is shown a bale 20 formed in accordance with the present invention consisting essentially of newsprint, e.g., newspapers 10 and 10A–10F, and storage containers 32 therefor. As is customary, bale 20 is bound in the compactor/baler 16 by suitable binding means 50 such as wire, straps, cord, rope, cable, or the like.

The producers of consumer goods 22 will find that additional expenses incurred by the inclusion of recyclable waste storage containers 32 into the consumer goods packages 10 which they produce can at least be partially, if not wholly, defrayed by using the exterior surfaces of the recyclable waste storage containers 32 as paid advertising for other consumer goods and services or free advertising for their own consumer goods. For example, a newspaper publisher might use the exterior surfaces of the waste storage containers 32 as paid advertising space for goods and services or as space for conveying public service messages from the publisher, e.g., messages to the effect that the publisher is a concerned supporter of community help programs, particularly the need for recycling, among others. It is also preferred that the storage container 32 be printed with use instructions on its exterior which may indicate, inter alia, the kinds of materials which are acceptable and/or unacceptable for insertion thereinto for recycling purposes.

Moreover, in the preferred application of the recycling system of the present invention, i.e., the recycling of newsprint, the waste storage containers 32 not only serves convenient disposable storage means which are compatible for recycling with the newsprint, but they may also serve, as noted previously, as important control elements for "self-regulating" the recycling process by assuring the addition of a supply of higher quality paper fibers which are essential for replenishing sub-standard paper fibers which are lost during recycling. That is to say, a predetermined quantity of higher quality fibers must be added during recycling of the newsprint and these fibers can conveniently be added by forming the composition of the waste storage containers with a predetermined and desired quantity of magazine paper stock.

As illustration, in large cities wherein many pounds of newsprint may be generated in the publication of a one-week supply of editions, or even a single edition, of a daily newspaper, the waste storage container 32 may be formed virtually entirely of higher quality and rugged magazine grade paper fibers in order to assist in the supply of the required higher quality fiber replenishment in the recycling process, and also to provide the strength necessary to contain the newsprint until the package 12 reaches the recycling facility. Conversely, in smaller cities and towns wherein only a few pounds of newsprint are typically generated in the publication of even a one-week supply of editions of a daily newspaper, the waste storage containers 32 may be suitably formed of a material mixture containing somewhat less low-grade paper fibers and somewhat more newsprint-grade paper fibers than the waste storage containers used in large cities, since, due to the generation of less newsprint in a given time period, less higher quality fibers are required for replenishment of sub-standard fibers lost during recycling and less strength is required for containing the reduced quantity of newsprint.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A method for recycling newsprint, said method comprising the steps of:

(a) obtaining an article for containing newsprint, said article consisting of bleached paper having primarily long grain soft wood fibers in quantities such that during recycling with said waste newsprint, said fibers replenish sub-standard paper fibers extracted and lost during recycling of the waste newsprint;

(b) placing an amount of newsprint in said article in order to form a unit of recyclable waste wood fiber products formed essentially entirely of materials suitable for recycling newsprint; and (c) using said long grain wood fibers during recycling of said unit of recyclable products to replenish lost sub-standard wood fiber during recycling of the newsprint.

2. The method of claim 1 further comprising obtaining a newspaper which forms part of said newsprint simultaneously with performing step (a), said article being a component of said newspaper.

* * * * *